US005353942A

United States Patent [19]

Dominguez

[11] Patent Number: 5,353,942

[45] Date of Patent: Oct. 11, 1994

[54] DEVICE FOR COVERING A CONTAINER OPENING

[76] Inventor: Oscar Dominguez, 26200 Frampton Ave., Apt. 68, Harbor City, Calif. 90710-3442

[21] Appl. No.: 101,035

[22] Filed: Aug. 3, 1993

[51] Int. Cl.[5] ..... B65D 51/18

[52] U.S. Cl. ..... 220/254; 220/711; 220/729

[58] Field of Search ..... 220/694, 711, 713, 729, 220/730, 254, 259, 356

[56] References Cited

U.S. PATENT DOCUMENTS

| | | | |
|---|---|---|---|
| 3,372,832 | 3/1968 | Yeater et al. | 220/254 |
| 3,680,732 | 8/1972 | Dickie | 220/694 X |
| 3,880,319 | 4/1975 | Wells et al. | 220/278 |
| 4,387,826 | 6/1983 | Heubl | 220/243 |
| 4,494,672 | 1/1985 | Pearson | 220/263 |
| 4,796,774 | 1/1989 | Nabinger | 220/711 |
| 5,088,614 | 2/1992 | Dumestre | 220/713 |
| 5,125,525 | 6/1992 | Tucker | 220/254 |
| 5,139,163 | 8/1992 | Diaz | 220/258 |
| 5,203,467 | 4/1993 | Tucker | 220/254 |

*Primary Examiner*—Allan N. Shoap

*Assistant Examiner*—Vanessa Caretto

*Attorney, Agent, or Firm*—Irving Keschner

[57] ABSTRACT

A device for covering the opening formed in a container after the original sealing pull-tab is removed by a user. The device comprises a wire member having a ring like portion fixedly positioned below the top rim of the container. A second portion of the wire member extends horizontally and then angularly downwardly toward the center area of the container top surface. A hinge, formed on the rear portion of a cover member having a surface contact area sufficiently large to cover the opening, is positioned at the rear of the second portion of the wire member. The front portion of the cover member has a channel portion which is adapted to engage the rim thus securing the cover member in position over the opening. The surface of the cover member contacting the container surface is recessed to accommodate the raised sealing dimple at the rear of the opening, the size of the recess being extended to cover containers having an essentially flat or recessed area surrounding the opening and containers which have raised portions formed around the opening when the pull-tab is removed.

2 Claims, 1 Drawing Sheet

FIG. 1
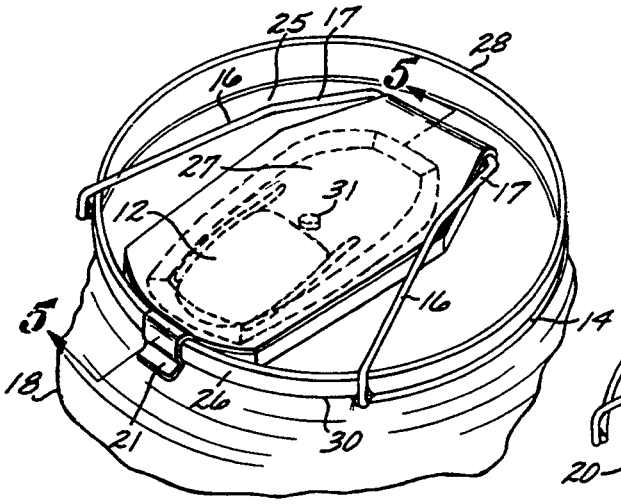
FIG. 3
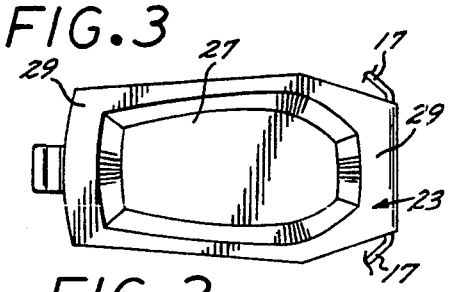
FIG. 2
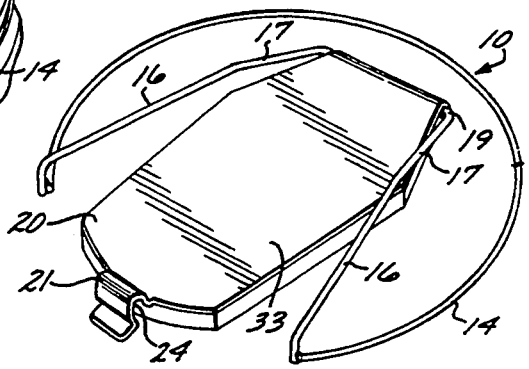
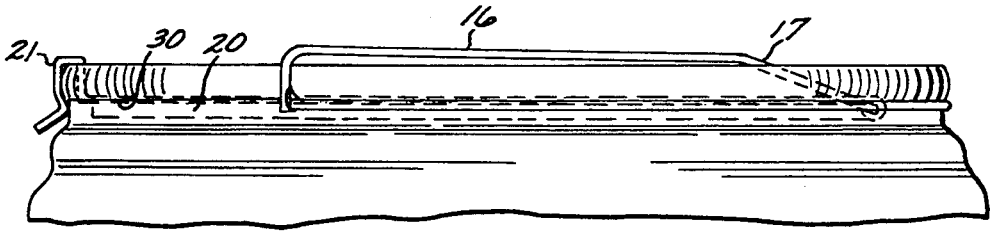
FIG. 4
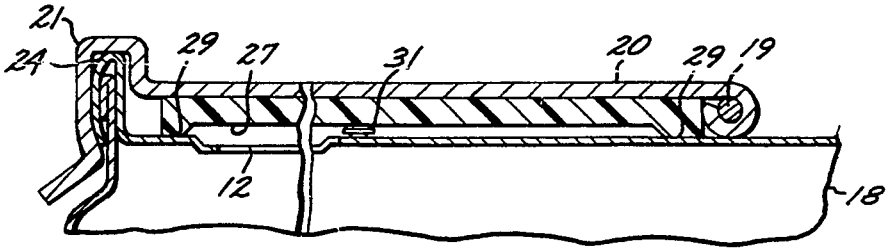
FIG. 5

DEVICE FOR COVERING A CONTAINER OPENING

BACKGROUND OF THE INVENTION

1. Field of the Invention

The present invention relates to covers for closing the opening formed in containers and, in particular, a simple and cost efficient device to accomplish that objective.

2. Description of the Prior Art

Covers for closing openings formed in containers have been widely disclosed in the prior art. For example, U.S. Pat. Nos. 3,372,832 to Yeater et al., 4,066,191 to Coleman, 4,387,826 to Heubl; 4,511,057 to Tontarelli; 4,796,774 to Nabinger; 5,088,614 to Dumestre and 5,125,525 to Tucker all disclose various configurations for covering the teardrop-shaped opening formed in liquid containers when the frangible pull-tab element is torn from the container.

Although the devices disclosed in the aforementioned patents function to close the open containers, they all have a common disadvantage of being relatively complex and expensive to fabricate. Even though these devices apparently are reusable after the initial container is discarded, if, as often occurs , it is necessary to cover more than container opening, the expense of each device becomes a limiting factor in a consumer's decision as to how many such devices will be purchased.

What is therefore desired is to provide a device for closing the opening formed in used containers which is simple to fabricate and which, in turn, is less costly than devices currently available.

SUMMARY OF THE PRESENT INVENTION

The present invention provides a device for covering the opening formed in a container after the original sealing pull-tab is removed by a user. The device comprises a wire member having a ring like portion fixedly positioned below the top rim of the container. A second portion of the wire member extends horizontally and then angularly downwardly toward the center area of the top surface of the container. A hinge, formed on the rear portion of a cover member having a surface contact area sufficiently large to cover the opening, is positioned at the rear of the second portion of the wire member. The front portion of the cover member has a channel portion which is adapted to engage the rim, thus securing the cover member in position over the opening. The surface of the cover member contacting the container surface is recessed to accommodate the raised sealing dimple at the rear of the opening, the size of the recess being extended to cover containers having an essentially flat or recessed area surrounding the opening and containers which have raised portions formed around the opening when the pull-tab is removed.

The device of the present invention is inexpensive to fabricate, simple to use and which nevertheless provides a sufficient sealing of the container even upon increased internal pressure based on gas formation.

BRIEF DESCRIPTION OF THE DRAWINGS

For a better understanding of the invention as well as other objects and further features thereof, reference is made to the following description which is to be read in conjunction with the accompanying drawing wherein:

FIG. 1 is a perspective view of the covering apparatus of the present invention covering an opening formed in a beverage can;

FIG. 2 is a perspective view of the covering apparatus of the present invention;

FIG. 3 is a view of the cover member showing a recess formed therein;

FIG. 4 is a side elevation view of FIG. 1;

FIG. 5 is a cross-sectional view along line 5—5 of FIG. 1.

DESCRIPTION OF THE INVENTION

Referring now to the figures, the device 10 for covering a container opening 12 comprises a circularly shaped portion 14, a horizontally extending portions 16 and portions 17 which extend downwardly at an angle towards the center of a container 18, a horizontally extending portion 19 and a cover portion 20. Cover portion 20 is hingedly mounted at the back portion thereof to horizontally extending portion 19. The front end 21 of cover portion 20 has an inverted channel portion 24 which is adapted to engage the rim 26 formed on the top of container 18 when the device is operational to close the teardrop-shaped opening 12 formed when the frangible pull-tab element (not shown) is torn from the container. The bottom surface 23 of cover 20 which contacts surface 25 of container 18 has a recess 27 formed therein to allow the raised sealing dimple, or rivet like-member 31 (initially functioning to maintain the pull-tab element in place) at the rear of the opening to extend into the recess, allowing the non-recessed flat portions 29 of surface 23 to form an effective seal with container surface 25, this in turn sealing opening 12. The size of recess 27 is greater than that necessary to accommodate the dimple 31 in order to provide sealing for those containers that have ridges formed around the opening after the tab is removed while also sealing those containers wherein the area around the opening is either coplanar with the rest of the top container surface or recessed therefrom.

In use, the diameter of the circularly shaped portion 14 is designed to be positioned over the top 28 of rim 26 and engage the lower portion 30 of rim 26 against the adjacent container surface in a fit sufficient to secure the device 10 to the container 18 in a position to enable the cover 20 to close opening 12 and maintain the carbonation and freshness of the liquid in the container as set forth hereinabove. Device 10 is first positioned properly on container 18, cover 20 is then rotated to the position shown in FIG. 1 and channel portion 24 is snapped over rim 26 to secure cover 20 in position.

The dimensions of device 10 are based on the standard sized metal containers utilized in the beverage industry. For example, the standard can includes a narrowed neck portion having the sealing rim portion formed therein and a frangible pull-up tab element formed in the substantially flat top surface of the container, an opening of standard size and position being formed on the surface when the element is torn from the container. These standard dimensions, in turn, allow the diameter of portion 14, the angular orientation of and length of portions 16 and 17, the width and length of cover 20 and the dimensions of recess 27 and the depth and width of the channel formed in member 24 to be properly selected. The wire-like portions of device 10 and portion 19 are fabricated from a material which is resilient, at least to the extent that shaped portion 14 can be positioned to engage lower portion 30 of rim 26, such as plastic or metal. The cover 20 itself may be fabricated from a soft material, such as a foam material sandwiched between plastic and metal layers (in the latter case, portion 19 may be fabricated as part of the metal layer). If desired, advertising material may be affixed to the top surface 33 of cover 20.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A device for covering an opening formed in a first surface of a container, said container having a longitudinally extending cylindrical surface and including a rim portion having upper and lower edges, said rim portion extending about the periphery of said first container surface comprising:

a member for covering said opening, said covering member having upper and lower surfaces, said lower surface defining means for contacting the first surface of the container, said lower surface having a recess, the recess defining means for enclosing said opening when said lower surface is in contact with the first surface of said container, said covering member having a coupling member at one end thereof and a member at the other end for engaging the upper edge of said rim portion; and means for supporting said covering member and securing it to said container comprising a first member encircling a portion of said container cylindrical surface and in contact therewith and positioned below said container rim portion and in contact with the lower edge to secure the covering member to the container, a second member coupled to said first member and extending in a direction toward the coupling member of said covering member, and a third member coupled to said second member, said third member engaging the coupling member of said covering member in a manner whereby said covering member can rotate between fist and second positions, said first, second and third members being joined together to form a internal member.

2. The device of claim 1 wherein said first member comprises plastic.

* * * * *